United States Patent [19]

Azzaroni

[11] 4,017,052

[45] Apr. 12, 1977

[54] TUNNEL LIKE FORMWORK

[76] Inventor: Giovanni Azzaroni, 8, Via Botticelli, Bologna, Italy

[22] Filed: Nov. 5, 1975

[21] Appl. No.: 628,959

[30] Foreign Application Priority Data

July 9, 1975 Italy ..... 12692/75

[52] U.S. Cl. ..... 249/183; 249/178; 249/188; 249/27

[51] Int. Cl.[2] ..... E04G 11/02; B28B 7/30

[58] Field of Search ..... 249/175, 179, 178, 180, 249/183, 184, 19, 20, 21, 22, 23, 24, 25, 26, 27, 28, 29, 30, 31, 185; 425/62, 63

[56] References Cited

UNITED STATES PATENTS

| | | | |
|---|---|---|---|
| 2,578,310 | 12/1951 | Lager | 249/179 |
| 3,373,571 | 3/1968 | Records | 425/63 X |
| 3,693,927 | 9/1972 | Jennings | 249/27 X |
| 3,815,861 | 6/1974 | Maier | 249/27 X |
| 3,822,853 | 7/1974 | Shelley | 249/180 X |

FOREIGN PATENTS OR APPLICATIONS

| | | | |
|---|---|---|---|
| 1,243,315 | 8/1960 | France | 249/180 |
| 1,928,196 | 12/1970 | Germany | 249/178 |
| 594,647 | 7/1959 | Italy | 425/63 |

*Primary Examiner*—J. Howard Flint, Jr.
*Attorney, Agent, or Firm*—Spencer & Kaye

[57] ABSTRACT

A tunnel-like formwork comprising two side shuttering panels connected together at their upper edges by a flexible upper shuttering panel. The side shuttering panels are provided with wheels. Inside of the said formwork, a framework structure is disposed, comprising at least four upright members to the upper ends of which four arms are hingedly connected, the said arms being in turn hingedly connected at their lower sides to one end of four inclined struts elements the other end of which is slidingly guided into a slide guide formed in the said upright members. The said upright members are provided at their lower ends with retractable bearing feet.

Power operated means are provided for simultaneously urging the said struts in a direction in which the arms hinged to said struts sustain the said flexible upper shuttering panel in a horizontal plain, and for lowering the said retractable feet into bearing engagement with the floor, while urging the two side shuttering panels sidewise, so as to place the formwork into operation.

3 Claims, 5 Drawing Figures

1
2
3
4
5
6
7
8
9
10
11
12
13
14
15
16
17
18
19
26
27
28
29
30
32
33
409
509
111

TUNNEL LIKE FORMWORK

FIELD OF THE INVENTION

This invention relates to the so called tunnel-like formworks for casting concrete to produce walls and floors, and is particularly concerned with formworks the shuttering members of which comprise vertical and horizontal members defining a tunnel like structure which may be placed into work and dismantled without disassembling one from another the shuttering members.

BACKGROUND OF THE INVENTION

Whenever a cellular structure, that is a structure composed by two vertical side walls and a horizontal floor is to be cast, tunnel like formworks are used composed by two vertical shuttering panels connected at their upper edges by a horizontal shuttering panel. The horizontal shuttering panel is normally supported by means of diagonal struts, fastened at one end to the lower side of the said upper shuttering, and at their other end to the vertical shuttering panels. Means are provided for adjusting the upper shuttering by means of the said struts. The vertical shutterings in turn are provided with adjustable bearing feet, and with wheels. When placing in operation the said frameworks, same are disposed side by side with the lower end of the vertical shuttering abutting against previously cast starter walls, and the vertical shutterings of adjacent formworks are connected together by means of suitable connecting wires.

The main disadvantages of the known tunnel-like formworks are that the operations requested for putting the said formworks into operation are time consuming and request a skilled workmanship.

SUMMARY OF THE INVENTION

It is one object of the present invention to provide a formwork for casting concrete which avoids these disadvantages. According to the invention, the above object is obtained by providing, in a tunnel-like formwork comprising two side shuttering panels connected together at their upper edges by a flexible upper shuttering panel, an inner framework structure comprising at least four upright members to the upper ends of which four arms are hingedly connected, the said arms being in turn hingedly connected at their lower sides to one end of four inclined strut elements the other end of which is slidingly guided into a slide guide formed in the said upright members; retractable bearing feet at the lower ends of the said upright members, and power operated means for simultaneously urging the said struts in a direction in which the arms hinged to said struts sustain the said flexible upper shuttering panel in a horizontal plan, and for lowering the said retractable feet into bearing engagement with the floor, whilst urging the two side panels sidewise, so as to place the formwork into operation.

Advantageously, the said power operated means are in the form of double action fluid operated cylinders, housing each a piston, the piston rods of which extend across the said formwork and are connected to each other, the said pistons being provided at their end opposite to the one to which the said piston rods are connected with a rod-like extension hingedly connected to the said side panels.

Further objects and advantages of the present invention will become apparent from the following description, made with reference to the accompanying drawings. BRIEF DESCRIPTION OF THE DRAWINGS In the drawings.

and

Figure 5:
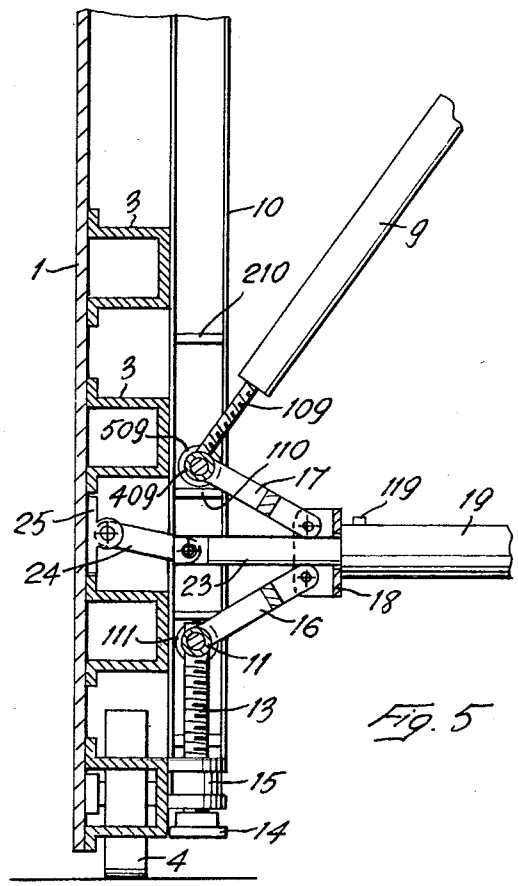
Figure 4:
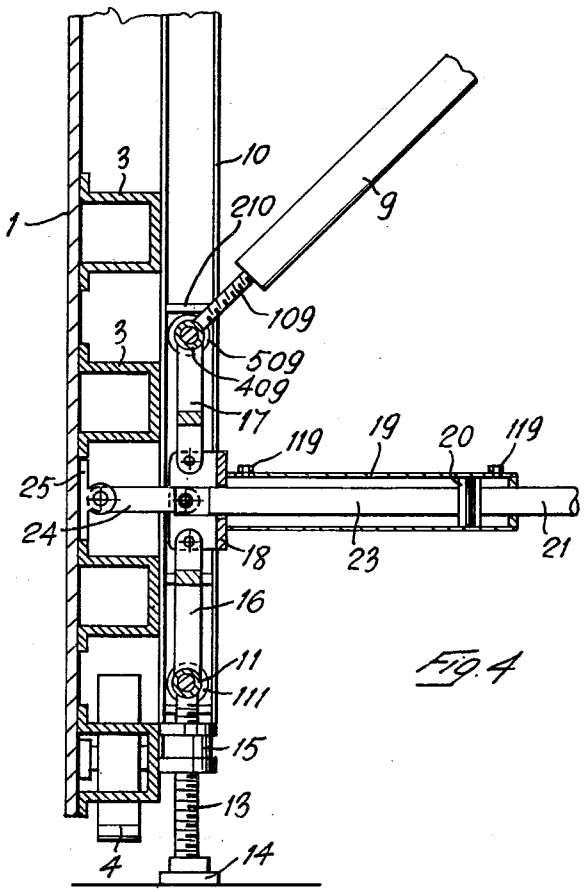

FIGS. 4 and 5 shows in enlarged scale a particular of the power operated device for the operation of the formwork of the invention. DESCRIPTION OF THE PREFERRED EMBODIMENT OF THE INVENTION With reference to the drawings, the tunnel-like formwork comprises two vertical shuttering panels 1, connected at their upper edges by a flexible upper shuttering panel 2. The upper panel 2 is composed by two side sections 102, and a central section 202 which is secured as for instance by means of bolts to the ends of the side sections 102. The central section may be changed in order to vary the width of the formwork.

Both the side panels 1 and the upper panel 2 are provided in a usual manner at their inner sides with longitudinal stiffening ribs 3.

The side panels 2 are provided at their lower edge with wheels 4.

Figure 2:
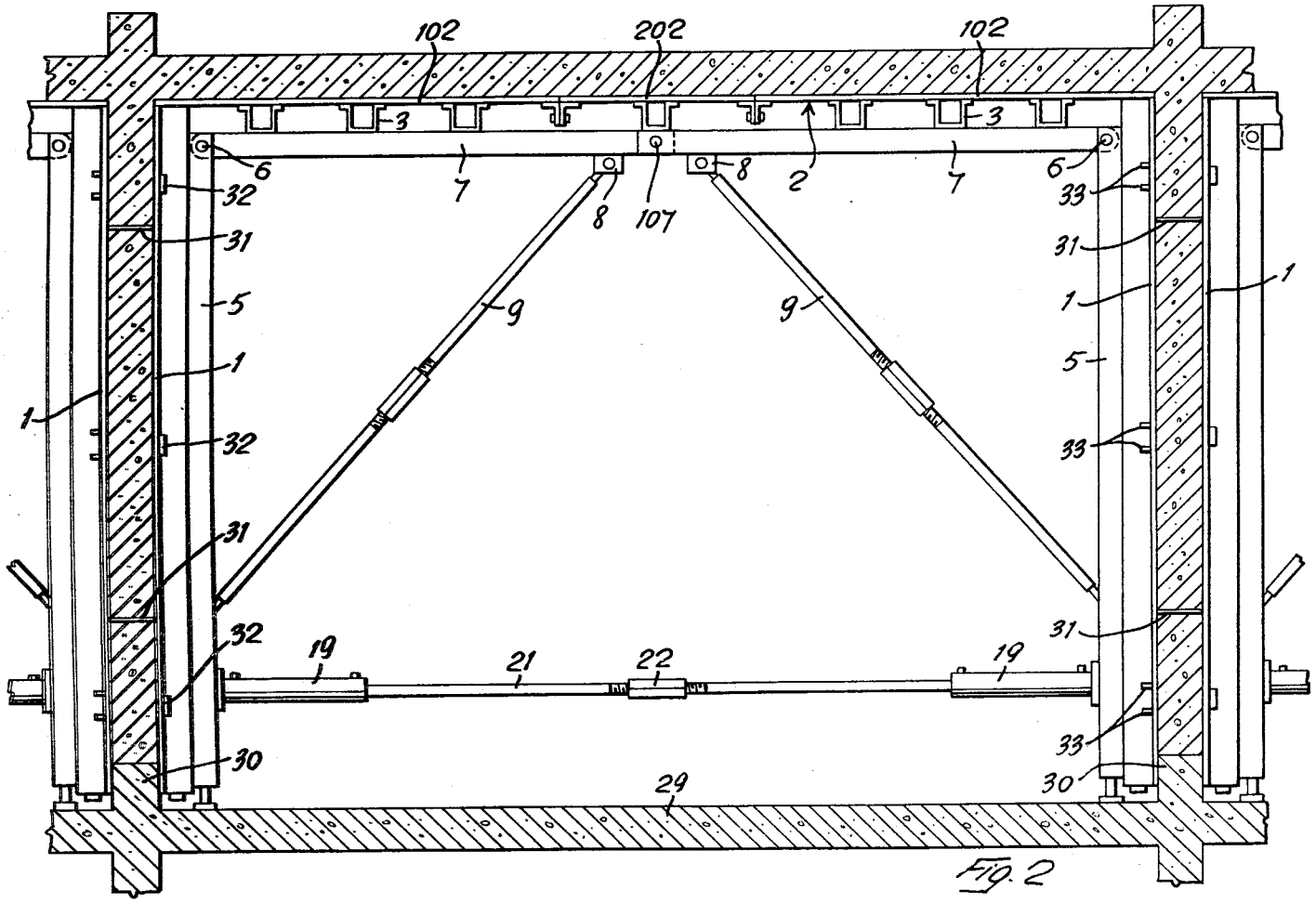
FIG. 2 is a view corresponding to FIG. 1, with the formwork in working condition.
Figure 3:
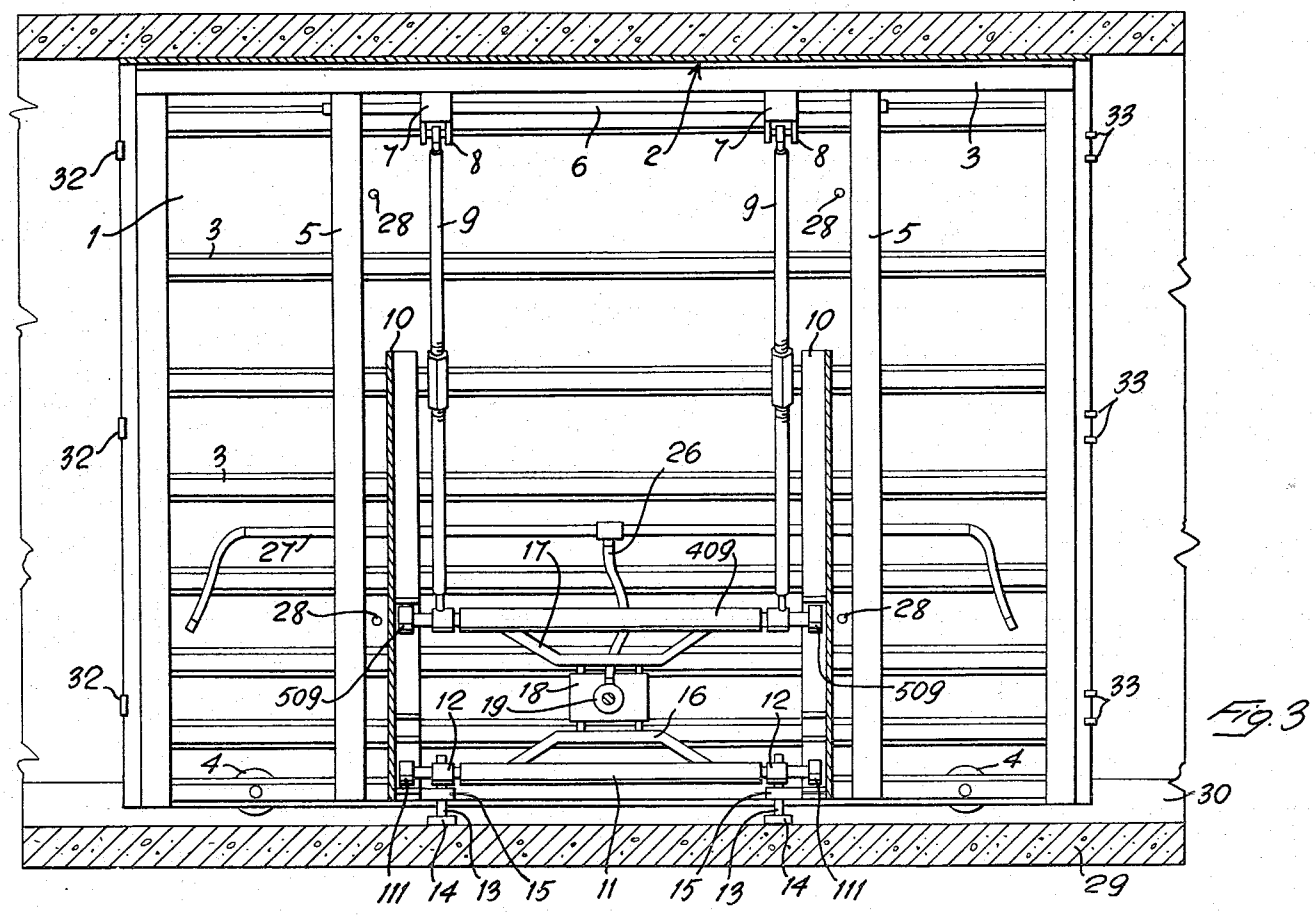
FIG. 3 is a side view of the formwork of FIGS. 1 and 2 in working condition, taken from the inner side of the formwork.

Inside of the above described formwork, a framework is mounted, which will be described with particular reference to FIGS. 2 and 3. As shown in the said Figures, to each side panel 1, a pair of upright members 5 are fastened, for instance by welding. The said upright members extend the whole height of the panels 1, and are spaced a certain distance the one from the other and from the lateral sides of the panels 1, parallel to the said sides.

Between the upper ends of each pair of uprights 5, a cross bar 6 is secured, to which a pair of arms 7 are pivotably secured by one end.

Each one of the said arms 7 extends half the width of the formwork, and each arm 7 of one pair is pivotably connected at its free end to the free end of the corresponding arm 7 of the other pair for instance by means of a bolt 107, which is passed through a bore formed in the said free ends of the said arms 7.

Figure 1:
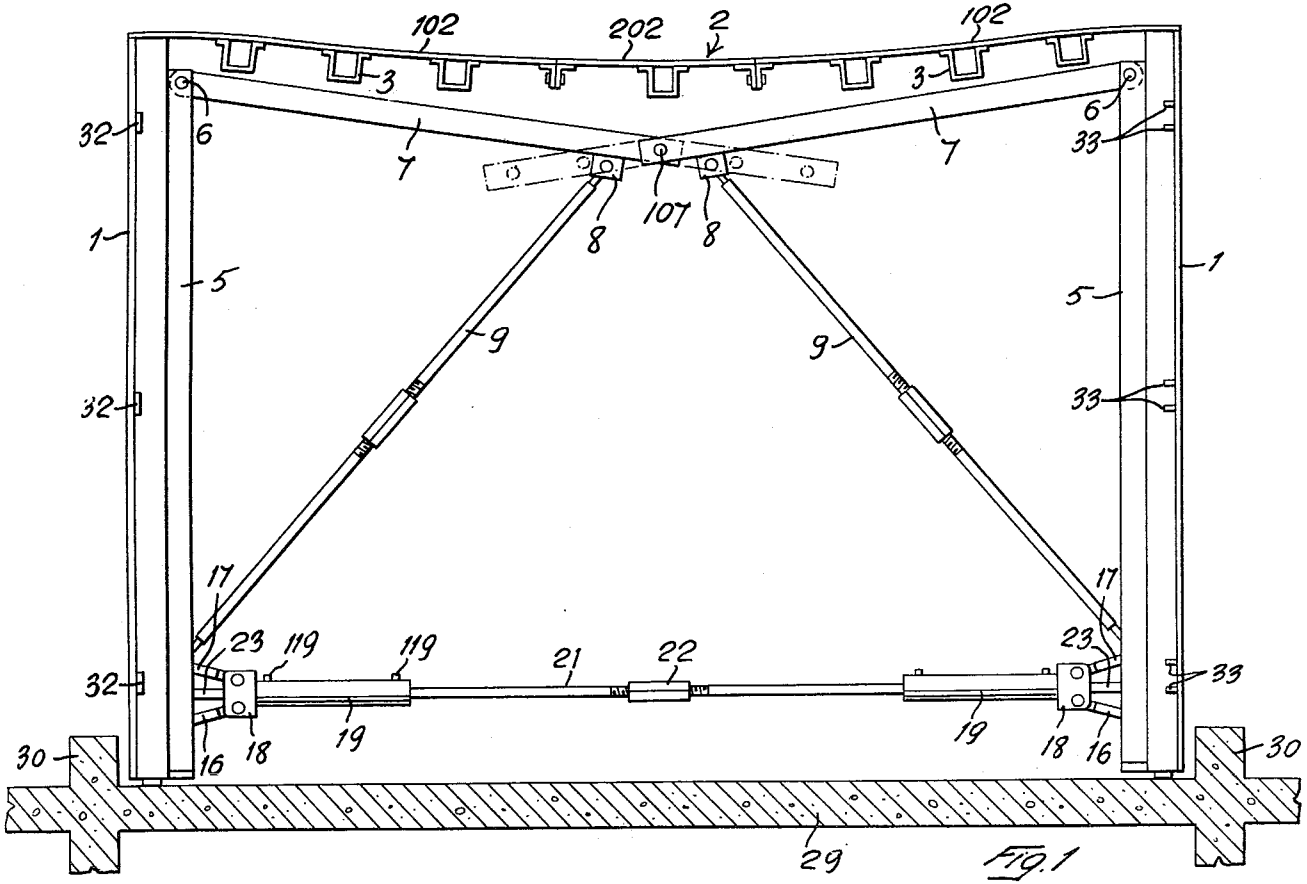
FIG. 1 is a front view of the formwork according to the invention, in dismantled condition.

As shown by dash lines in FIG. 1, the said arm 7 may be provided with a number of through bores, so as to permit to vary the width of the formwork.

To the lower side of the arms 7, at an intermediate region thereof, the ears 8 are fastened, to each of which one end of four struts 9 is hinged. The struts 9 are each provided at their other end with a treaded axial boring in which a threaded spindle 109 is screwed. At their free ends the spindles 109 are each provided with a sleeve 209, the sleeves 209 of each pair of struts being rotatably supported on a spindle 409 provided at its ends with wheels 509 which are guided into vertical guides 10 secured to the panels 1, for movement between the abutment members 110, 210.

Reference numeral 11 denotes a second spindle, which is provided at its ends with wheels 111 which are guided for sliding movement in the lower ends of the guides 10. On each spindle 11 two sleeves 12 are inserted to which the rods 13 of the bearing feet 14 are fastened. The rods 13 are slidingly guided for a movement in a vertical direction into the sleeves 15 fastened to the outer sides of the guides 10.

To the spindles 409 and 11 a pair of substantially V shaped struts 16 and 17 are connected by their diverging ends, for instance by welding, the said struts 16 and 17 being hingedly connected at their vertex to a plate 18 carried by one end of a fluid operated double acting cylinder 19. Inside of each cylinder 19 a piston 20 is slidably housed, the pistons of the two opposed cylinders being each provided with piston rods 21 extending coaxially toward the center of the formwork, the confronting ends of the piston rods 21 being threaded and connected together by means of a threaded sleeve 22.

Each piston 21 is further provided on its side opposite to the side to which the rod 21 is fastened, with a coaxial rod-like extension 23, extending outwardly of cylinder 19 for a length which is substantially equal to the stroke of the piston 20 inside cylinder 19. To the free end of the said extension 23 one end of a link 24 is hinged, the other end of said link 24 being hingedly connected to one ear 25 secured, for instance by welding, to the panel 1. The cylinders 19 are each provided near their ends with two nipples 119, connected through hoses 26 to a main operating fluid supply line 27, connected to an operating fluid source (not shown). The panels 1 are further provided with through bores 28, for the passage of connecting straps for connecting the shuttering panels of two adjacent formworks.

OPERATION OF THE DESCRIBED EMBODIMENT OF THE INVENTION

In order to start a concrete casting operation, the pistons 20 are urged outwardly in the cylinders 19, thus retracting the piston rods 21 in the cylinders. This causes, through struts 16 and spindle 11, the lifting of the bearing feet 14, allowing the formwork to stand on the wheels 4. This causes further through struts 17 and spindle 409, the lowering of struts 9, thus swinging the arms 7 downwardly around spindle 6, thus promoting in cooperation with the action of the link 24, the collapsing of the formwork for a short length.

The upper panel 2, which is no more sustained by the arms 7, flexes downwardly towards its center region.

With the formwork in this condition, same may be wheeled by means of its wheels 4 on the floor 29 between a pair of starter walls 30.

For the purposes of the present description, it is assumed that the bearing feet 14, the length of the struts 9, the length of the arms 7, the width of the upper panel 2, and the length of the piston rods 21 have been previously adjusted to the desired degree, in usual manner.

Once in position, the operating fluid is admitted in cylinder 19, in a direction so as to push the pistons 20 toward one another.

This entrains simultaneously the lowering of the feet 14, which bear on the floor 29, lifting the formwork to the desired height, the lifting of the struts 9, with consequent rocking of the arms 7 until they are aligned into a horizontal plane, and the straightening of the links 24, which come into alignment with the rod extensions 23 of the pistons 20. By the action of the links 24 and of the arms 7, the side shuttering panels are spaced apart until they come to bear against the starter walls 30, and the upper panel is stretched into its horizontal condition, bearing on arms 7, as shown in FIG. 2. The formwork is ready for the casting operation. Before starting concrete casting, adjacent formworks are connected together by means of straps 31 which are passed through the bores 28 formed in the side shutterings 1.

Besides being connected together sidewise by means of the straps 31, the formworks may be connected together endwise by means of mating connecting male-and-female joints 32, 33 secured to the front sides of the shuttering panels 1.

I claim:

1. Apparatus providing two laterally spaced, parallel, vertical mold form surfaces and one elevated horizontal mold form surface extending between the upper edges of the vertical mold form surfaces, for use in the casting of concrete, in situ, to form the walls and floors of a building, said apparatus comprising a tunnel-like formwork composed of:

two side shuttering panels each defining a respective one of the vertical mold form surfaces;

a flexible upper shuttering panel composed of two side sections, each fastened to the upper edge of a respective one of said side shuttering panels, and an intermediate, replaceable control section disposed between, and bolted to, said side sections, said two side sections and said intermediate section having upper surfaces defining the horizontal mold form surface; and a plurality of supporting wheels pivotally mounted to the lower edges of said side shuttering panels and projecting below said side panels for permitting rolling of said apparatus to a work location, and a framework structure disposed inside of said formwork and composed of:

at least two pairs of upright members, with the members of each pair being disposed opposite one another and one member of each pair being fastened to a respective one of said side shuttering panels and being substantially coextensive in height with said side shuttering panels;

at least two pairs of arms, each pair of arms being associated with a respective pair of said upright members, one arm of each pair being pivotally connected at one end to the upper edge of a respective upright member of its associated pair and the two arms of each pair being pivotally connected together at their respective other ends;

a plurality of pairs of inclined struts, each pair being associated with a respective pair of said arms and each strut having an upper end pivotally connected to a respective arm of its associated pair at a point near said other end of its respective arm, each said strut having an adjustable length;

two pairs of parallel, vertical guide members, with each guide member of each pair being secured to a respective one of said side shuttering panels, and each guide member defining a vertical guide channel;

a pair of first shafts each disposed adjacent a respective one of said side shuttering panels and two pairs of first guide wheels, with the guide wheels of each pair being rotatably mounted on respective ends of a respective one of said first shafts and each first guide wheel being located in a guide channel of a respective one of said guide members which is secured to that side shuttering panel which is associated with the shaft on which said guide wheel is mounted, each said guide wheel being vertically movable in the guide channel in which it is located;

a plurality of pairs of sleeves, each pair being associated with a respective pair of said struts and each sleeve being secured to the lower end of a respective strut of its associated pair and being pivotally mounted on a respective shaft of said pair of first shafts;

a pair of second shafts each disposed adjacent a respective one of said side shuttering panels at a location below a respective one of said first shafts and two pairs of second guide wheels, with the wheels of each pair being rotatably mounted on respective ends of a respective one of said second shafts and each second guide wheel being located in a guide channel of a respective one of said guide members which is secured to that side shuttering panel which is associated with the second shaft on which said second guide wheel is mounted, each said second guide wheel being vertically movable in the guide channel in which it is located, below said first guide wheel located in the same guide channel;

two pairs of bearing feet, with one foot of each pair being connected to a respective one of said second shafts and extending downwardly for movement, with its respective shaft, in a vertical direction to an extended position in which said foot projects below said supporting wheels;

power actuated reciprocating means comprising two double acting, fluid driven cylinders extending between said side shuttering panels and each containing a piston and each disposed adjacent a respective associated one of said side shuttering panels, a pair of first piston rods each connected to a respective one of said pistons and extending through one end of its associated cylinder, said rods having their free ends extending toward one another, means connecting said free ends of said first piston rods together while permitting adjustment of the distance between said pistons, a pair of connecting plates each secured to a respective one of said cylinders at the end thereof directed toward its associated side shuttering panel, and a pair of second piston rods each connected to a respective one of said pistons and extending through the end of its associated cylinder to which the respective plate is secured, each said second rod extending through said respective plate;

a pair of first links each having one end pivotally connected to a respective one of said plates and its other end pivotally connected to that respective one of said first shafts associated with the same side shuttering panel;

a pair of second links each having one end pivotally connected to a respective one of said plates and its other end pivotally connected to that respective one of said second shafts associated with the same side shuttering panel; and a pair of third link means each having one end pivotally connected to the free end of a respective one of said second piston rods and its other end pivotally connected to the associated one of said side shuttering panels;

whereby movement of said cylinders away from one another causes simultaneous upward movement of all of said first guide wheels to move all of said struts in a direction to raise all of said arms into a common horizontal plane, downward movement of all of said second guide wheels to move all of said bearing feet into bearing engagement with the underlying surface, and outward movement of said side shuttering panels to stretch said upper shuttering panel in a horizontal plane.

2. A framework according to claim 1, in which the said cylinders are connected to a common operating fluid source.

3. An arrangement according to claim 1, in which means are provided for interconnecting at least two formworks disposed laterally adjacent one another.

* * * * *